US009551054B2

(12) United States Patent
Shikama et al.

(10) Patent No.: US 9,551,054 B2
(45) Date of Patent: Jan. 24, 2017

(54) 7XXX SERIES ALUMINUM ALLOY MEMBER EXCELLENT IN STRESS CORROSION CRACKING RESISTANCE AND METHOD FOR MANUFACTURING THE SAME

(71) Applicant: Kobe Steel, Ltd., Kobe-shi (JP)

(72) Inventors: Takahiro Shikama, Shimoneseki (JP); Shinji Yoshihara, Shimonoseki (JP)

(73) Assignee: Kobe Steel, Ltd., Kobe-shi (JP)

( * ) Notice: Subject to any disclaimer, the term of this patent is extended or adjusted under 35 U.S.C. 154(b) by 292 days.

(21) Appl. No.: 14/154,732

(22) Filed: Jan. 14, 2014

(65) Prior Publication Data

US 2014/0209222 A1 Jul. 31, 2014

(30) Foreign Application Priority Data

Jan. 25, 2013 (JP) ..... 2013-012394

(51) Int. Cl.
*C22F 1/053* (2006.01)
*C22C 21/10* (2006.01)

(52) U.S. Cl.
CPC ..... *C22F 1/053* (2013.01); *C22C 21/10* (2013.01)

(58) Field of Classification Search
CPC ..... C22C 21/10; C22F 1/053
USPC ..... 148/417, 439, 695
See application file for complete search history.

(56) References Cited

U.S. PATENT DOCUMENTS

2005/0189694 A1 9/2005 Kotani

FOREIGN PATENT DOCUMENTS

| | | |
|---|---|---|
| JP | 7-305151 | 11/1995 |
| JP | 10-168553 | 6/1998 |
| JP | 2000-96174 A | 4/2000 |
| JP | 2005-105327 | 4/2005 |
| JP | 2005-194020 | 7/2005 |
| JP | 2007-119853 | 5/2007 |
| JP | 2007-254833 | 10/2007 |
| JP | 2010-69927 | 4/2010 |

(Continued)

OTHER PUBLICATIONS

English language machine translation of JP 10-168553 to Minoda et al. Generated Mar. 7, 2016.*

*Primary Examiner* — Brian Walck
(74) *Attorney, Agent, or Firm* — Oblon, McClelland, Maier & Neustadt, L.L.P.

(57) ABSTRACT

An aluminum alloy member resistant to cracking and having high strengths and excellent stress corrosion cracking resistance is manufactured by expanding a 7xxx aluminum alloy hollow extrusion at a rate of 5% or more. Specifically, a 7xxx aluminum alloy hollow extrusion containing Zn of 3.0-9.5%, Mg of 0.4-2.5%, Cu of 0.05-2.0%, and Ti of 0.005-0.2%, in mass percent, and prepared through press quenching is subjected to a reversion treatment, to pipe expansion within 72 hours after the reversion treatment, and to temper aging. The reversion treatment includes heating at a temperature rise rate of 0.4° C./second or more, holding in a temperature range of 200-550° C. for longer than 0 second, and cooling at a rate of 0.5° C./second or more. The ratio Y ($\sigma_{rs}/\sigma_{0.2}$) of the tensile residual stress $\sigma_{rs}$ to the 0.2% yield stress $\sigma_{0.2}$ after temper aging and the total content X of Mg and Zn satisfy Expression (1):

$$Y \leq -0.1X+1.4 \quad (1).$$

7 Claims, 3 Drawing Sheets

(56) References Cited

FOREIGN PATENT DOCUMENTS

| | | |
|---|---|---|
| JP | 2010-159005 | 7/2010 |
| JP | 2010-196089 | 9/2010 |

* cited by examiner

No.5

No.23

7XXX SERIES ALUMINUM ALLOY MEMBER EXCELLENT IN STRESS CORROSION CRACKING RESISTANCE AND METHOD FOR MANUFACTURING THE SAME

FIELD OF INVENTION

The present invention generally relates to 7xxx series aluminum alloy members formed by subjecting high-strength 7xxx series aluminum alloy hollow extrusions to pipe expanding; and methods for manufacturing the members. Specifically, the present invention relates to a 7xxx series aluminum alloy member having excellent resistance to stress corrosion cracking; and a method for manufacturing the member.

BACKGROUND OF INVENTION

Japanese Unexamined Patent Application Publication (JP-A) No. 2010-159005 and JP-A No. 2010-69927 describe pipe expanding of 6xxx series aluminum alloy hollow extrusions by electromagnetic forming. JP-A No. 2007-254833 and JP-A No. 2005-105327 describe 6xxx series aluminum alloy hollow extrusions having excellent expanding workability and being formed by electromagnetic forming. JP-A No. 2010-196089 describes a 6xxx series aluminum alloy hollow extrusion having excellent expanding workability and being formed by hydroforming. The 6xxx series aluminum alloy hollow extrusions described in these patent literatures each subjected to pipe expanding under a condition of T1 temper where the material exhibits high formability, and thereafter aged.

Independently, the application of pipe expanding to 7xxx series aluminum alloy hollow extrusions has been examined, which materials contain alloy elements such as Zn, Mg, and Cu in large amounts and thereby have higher strengths after temper aging than other series alloys do. The 7xxx series aluminum alloy extrusions, however, even being materials (T1 temper materials) after press quenching and before temper aging, undergo hardening due to natural aging and suffer from inferior formability. For this reason, the 7xxx series aluminum alloy hollow extrusions, when subjected to pipe expanding at a practical-level expansion rate of 5% or more, readily stiffer from cracking in the expanded (worked) sites. This tendency is more remarkable in higher alloys.

For better formability, a reversion treatment has been performed on 7xxx series aluminum alloys hardened by natural aging, as described typically in JP-A No. H07-305151, JP-A No. H10-168553, JP-A No. 2005-194020, and JP-A No. 2007-119853.

SUMMARY OF INVENTION

Technical Problem

To be sure, the reversion treatment, when applied to a T1 temper 7xxx series aluminum alloy extrusion, helps the extrusion to have a lower strength and generally exhibits better formability. However, the 7xxx series aluminum alloy hollow extrusion, when subjected to pipe expanding typically by electromagnetic forming, is not sufficiently effectively protected from cracking at a practical-level expansion rate. In addition, the 7xxx series aluminum alloy hollow extrusion, even if not suffering from cracking, disadvantageously has inferior stress corrosion cracking resistance because a high tensile residual stress is imparted to an expanded area (worked site) after pipe expanding.

The present invention has been made under these circumstances, and an object thereof is to prevent cracking and to reduce tensile residual stress so as to give better stress corrosion cracking resistance in a 7xxx series aluminum alloy member formed by subjecting a 7xxx series aluminum alloy hollow extrusion to pipe expanding at a practical-level expansion rate of 5% or more.

Solution to Problem

The present invention provides a 7xxx series aluminum alloy member having excellent stress corrosion cracking resistance. The 7xxx series aluminum alloy member is formed by subjecting a 7xxx series aluminum alloy hollow extrusion to pipe expanding at an expansion rate of 5% or more, in which the 7xxx series aluminum alloy hollow extrusion contains: Zn in a content of from 3.0 to 9.5 percent by mass; Mg in a content of from 0.4 to 2.5 percent by mass; Cu in a content of from 0.05 to 2.0 percent by mass; and Ti in a content of from 0.005 to 0.2 percent by mass; the hollow extrusion may further contain at least one element selected from the group consisting of Mn in a content of from 0.01 to 0.3 percent by mass; Cr in a content of from 0.01 to 0.3 percent by mass; and Zr in a content of from 0.01 to 0.3 percent by mass; the hollow extrusion further contains Al and inevitable impurities; the hollow extrusion does not suffer from cracking due to the pipe expanding; the member after the pipe expanding is subjected to temper aging; and the member after the temper aging satisfies conditions as specified by Expressions (1) to (3) as follows:

$$Y \leq -0.1X + 1.4 \quad (1)$$

$$Y = \sigma_{rs}/\sigma_{0.2} \quad (2$$

$$X = [Mg] + [Zn] \quad (3)$$

where σrs represents a tensile residual stress after the temper aging; $\sigma_{0.2}$ represents a 0.2% yield stress of the member after the temper aging; and [Mg] and [Zn] represent contents (in mass percent) of Mg and Zn, respectively.

The 7xxx series aluminum alloy member having excellent stress corrosion cracking resistance may be manufactured by subjecting a 7xxx series aluminum alloy hollow extrusion to a reversion treatment; subjecting the hollow extrusion to pipe expanding at an expansion rate of 5% or more within 72 hours after the reversion treatment to give a member; and temper aging the member after the pipe expanding, in which the 7xxx series aluminum alloy hollow extrusion is formed by press quenching, and the reversion treatment includes the substeps of heating the material at a rate of temperature rise of 0.4° C./second or more; holding the material in a temperature range of from 200° C. to 550° C. for a duration of longer than 0 second; and subsequently cooling the material at a cooling rate of 0.5° C./second or more.

Advantageous Effects of Invention

The present invention can provide a 7xxx series aluminum alloy member that is formed by subjecting a 7xxx series aluminum alloy hollow extrusion to pipe expanding at a practical-level expansion rate of 5% or more. The member has a high strength, is resistant to cracking, and exhibits better stress corrosion cracking resistance with lower tensile residual stress.

BRIEF DESCRIPTION OF DRAWINGS

FIGS. 2A-1, 2A-2, 2B-1, and 2B-1 are diagrams explaining pipe expanding in working examples, in which FIG. 2A-1 is a plan view where flanging is performed as the pipe expanding ; FIG. 2A-2 is a cross-sectional view along line A-A in FIG. 2A-1; FIG. 2B-1 is a plan view where simple pipe expanding is performed as the pipe expanding; and FIG. 2B-2 is a cross-sectional view along line B-B in FIG. 2B-1.

DETAILED DESCRIPTION OF THE PREFERRED EMBODIMENTS

Figure 1:
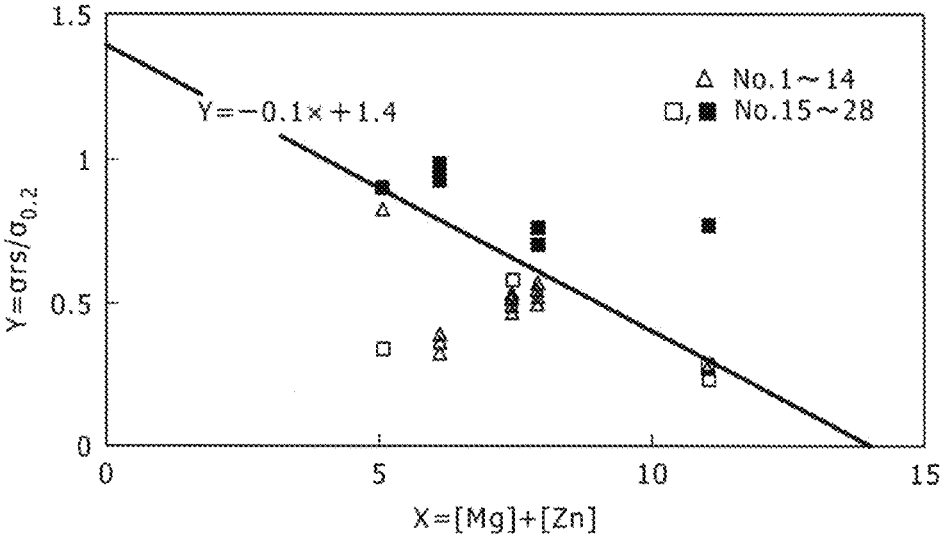
FIG. 1 is a graph indicating how the parameter Y ($=\sigma_{rs}/\sigma_{0.2}$) varies depending on the parameter X (=[Mg]+[Zn]) in 7xxx series aluminum alloy hollow extrusions.

Hereinafter the 7xxx series aluminum alloy member and the manufacturing method thereof according to embodiments of the present invention will be specifically illustrated.

Aluminum Alloy Chemical Composition

Initially, the chemical composition of a 7xxx series aluminum alloy for use in the present invention will be illustrated. However, this chemical composition itself is publicly known as that of 7xxx series aluminum alloys.

Zn: 3.0 to 9.5 percent by mass

Mg: 0.4 to 2.5 percent by mass

Zinc (Zn) and magnesium (Mg) elements form an intermetallic compound $MgZn_2$ to help the 7xxx series aluminum alloy to have higher strengths. Zn contained in a content of less than 3.0 percent by mass, or Mg contained in a content of less than 0.4 percent by mass may fail to help the resulting member to have a yield stress of 200 MPa or more which is necessary as a practical member. In contrast, Zn contained in a content of more than 9.5 percent by mass or Mg contained in a content of more than 2.5 percent by mass may fail to protect the hollow extrusion from cracking and fail to reduce the tensile residual stress imparted by the pipe expanding when the hollow extrusion is subjected to pipe expanding at a practical-level expansion rate. This may cause the resulting member to have remarkably inferior stress corrosion cracking resistance even when the hollow extrusion is subjected to a predetermined reversion treatment prior to the pipe expanding. For higher strengths and a smaller weight, the Zn and Mg contents are preferably higher alloy sides. For example, the Zn and Mg contents are preferably from 5.0 to 9.5 percent by mass and from 1.0 to 2.5 percent by mass, respectively. In this view, the total of Zn and Mg contents is preferably from 6.0 to 12.0 percent by mass Cu: 0.05 to 2.0 percent by mass Copper (Cu) element helps the 7xxx series aluminum alloy to have higher strengths. Cu contained in a content of less than 0.05 percent by mass may fail to contribute to sufficiently higher strengths. In contrast, Cu contained in a content of more than 2.0 percent by mass may cause the hollow extrusion to have inferior extrusion workability. The Cu content is preferably from 0.5 to 1.5 percent by mass.

Ti: 0.005 to 0.2 percent by mass

Titanium (Ti) element effectively contributes to refinement of grains upon casting of the 7xxx series aluminum alloy and thereby improves the formability (expanding workability) thereof For this reason, Ti is added in a content of 0.005 percent by mass or more. In contrast, Ti contained in a content of more than 0.2 percent by mass may exhibit saturated activities, cause coarse intermetallic compounds to precipitate, and cause reduction in formability contrarily.

Mn: 0.01 to 0.3 percent by mass

Cr: 0.01 to 0.3 percent by mass

Zr: 0.01 to 0.3 percent by mass

Manganese (Mn), chromium (Cr), and zirconium (Zr) elements effectively suppress recrystallization of the 7xxx series aluminum alloy extrusion, allows the grain microstructure to be a fine recrystallized microstructure or fiber microstructure, and helps the member to have better stress corrosion cracking resistance. For these reasons, at least one of these elements may be added according to necessity within the above-specified ranges.

Inevitable Impurities

Major examples of inevitable impurities in the 7xxx series aluminum alloy include Fe and Si. The contents of Fe and Si are controlled to 0.35 percent by mass or less and 0.3 percent by mass or less, respectively, so as not to degrade properties of the 7xxx series aluminum alloy.

Aluminum Alloy Member Manufacturing Method

The 7xxx series aluminum alloy member according to the present invention may be manufactured by preparing, through press quenching, a 7xxx series aluminum alloy hollow extrusion having the chemical composition (generally the prepared extrusion is stored for a duration of from several tens of days to several months); subjecting the extrusion to a reversion treatment; subjecting the resulting material to pipe expanding at an expansion rate of 5% or more within 72 hours after the reversion treatment to give a member; and subjecting the entire member to temper aging, in which the reversion treatment includes the substeps of heating the extrusion at a rate of temperature use of 0.4° C./second or more; holding the extrusion within a temperature range of from 200° C. to 550° C. for a duration of longer than 0 second; and subsequently cooling the extrusion at a cooling rate of 0.5° C./second or more.

The material hollow extrusion can be manufactured according to any of various extrusion procedures. Among them, indirect extrusion is more preferred than direct extrusion so as to prevent the formation of coarse recrystallized grains on the extrusion surface; whereas mandrel extrusion is more preferred than porthole extrusion so as to ensure uniformity in cross-sectional microstructure (to avoid a deposit zone).

The hollow extrusion manufactured through press quenching is hardened due to natural aging and resulting intermetallic compounds precipitation. The reversion treatment performed prior to pipe expanding allows the intermetallic compounds to be dissolved again and helps the hollow extrusion to be softer (more flexible) and to exhibit better formability (expanding workability). This prevents cracking in the expanded area of the hollow extrusion upon pipe expanding and concurrently reduces the tensile residual stress generated in the expanded area.

A reversion treatment performed at a rate of temperature rise of less than 0.4° C./second may promote precipitation of intermetallic compounds during the temperature rise process. A reversion treatment performed for a holding temperature (actual work temperature) of lower than 200° C. may fail to help the intermetallic compounds precipitated through natural aging to be dissolved again. In any case, the reversion treatment fails to give desired effects. In contrast, a reversion treatment performed at a holding temperature of higher than 550° C. might cause burning. A reversion treatment performed through slow cooling at a cooling rate from the holding temperature of less than 0.5° C./second may cause the hollow extrusion to be an annealed aluminum alloy material, and this may cause the member to have insufficient strengths after temper aging. After reaching a holding temperature, the hollow extrusion should be held at the holding temperature for a duration of longer than 0 second. Specifically, the extrusion after reaching the holding temperature may be held at the holding temperature for a predetermined duration before cooling, or may be cooled immediately. The holding time is not critical in its upper limit, but is desirably shorter for satisfactory production efficiency, and is typically preferably 20 seconds or shorter, more preferably 10 seconds or shorter, and furthermore preferably 5 seconds or shorter. The heating may be performed with a device such as high frequency induction heating equipment or a salt-bath furnace.

After the reversion treatment, pipe expanding is performed before the extrusion is hardened again. Specifically, the pipe expanding is preferably performed within 72 hours after the reversion treatment. The pipe expanding may be performed by a procedure such as electromagnetic forming described in JP-A No. 2010-159005, JP-A No. 2010-69927, JP-A No. 2007-254833, and JP-A No. 2005-105327; hydroforming described in JP-A No. 2010-196089; forming with a jig described in JP-A No. 2007-119853; or multiple forming described typically in JP-A No. 2006-305587. The pipe expanding is performed at a practical-level expansion rate of 5% or more. Practically, the expansion rate is preferably 10% or more, and more preferably 20% or more. In general, the maximum of expansion rate at which pipe expanding can be performed without cracking becomes smaller with the alloy chemical composition becoming a higher alloy (with an increasing total content of [Mg]+[Zn]) and is smaller in the fiber microstructure than in the recrystallized microstructure. The expansion rate in the pipe expanding may be selected within such rates as to enable pipe expanding without cracking, according to the alloy chemical composition and alloy microstructure. The alloy chemical composition specified in the present invention attains a high expansion rate as much as about 140% without causing cracking. However, the expansion rate is preferably controlled to 100% or less and more preferably controlled to 90% or less so as to uniformize deformation all around the extrusion (to prevent local reduction in wall thickness).

Temper aging after the pipe expanding may be performed under known conditions as performed in regular 7xxx series aluminum alloys. The aging helps the product 7xxx series aluminum alloy member to surely have a strength (0.2% yield stress) of 200 MPa or more.

Assume that a 7xxx series aluminum alloy member manufactured by the manufacturing method has a tensile residual stress of $\sigma_{rs}$ in the expanded area and has a 0.2% yield stress of $\sigma_{0.2}$; whereas the material 7xxx series aluminum alloy has a Mg content of [Mg] and a Zn content of [Zn]. In this case, the ratio Y ($=\sigma_{rs}/\sigma_{0.2}$) of $\sigma_{rs}$ to $\sigma_{0.2}$ and the total X (=[Mg]+[Zn]) of [Mg] and [Zn] satisfy the condition as specified by Expression (1). The resulting aluminum alloy member, even though having high strengths, exhibits excellent stress corrosion cracking resistance in the expanded area.

The graph illustrated in FIG. 1 depicts plots of data obtained in after-mentioned working examples on X-Y coordinates, where X (=[Zn]+[Mg]) represents the total content of Zn and Mg; and Y ($=\sigma_{rs}/\sigma_{0.2}$) represents the ratio of the tensile residual stress ($\sigma_{rs}$) to the 0.2% yield stress ($\sigma_{0.2}$). The data are plotted by open triangles, open squares, and filled squares. The line in FIG. 1 is a straight line expressed as $Y=-0.1X+1.4$. In FIG. 1, data plotted by open triangles correspond to Samples Nos. 1 to 14 as Examples. All these data fell within the range of $Y\leq-0.1X+1.4$, and all the corresponding samples exhibited excellent stress corrosion cracking resistance, as demonstrated in Table 2. In FIG. 1, data plotted by open squares and filled squares correspond to Samples Nos. 15 to 28 as Comparative Examples. Among them, all the Comparative Examples (Samples Nos. 17, 23, 24, and 26 to 28) corresponding to the data plotted by open squares fell within the range of $Y\geq-0.1X+1.4$ and exhibited excellent stress corrosion cracking resistance; whereas all the Comparative Examples (Samples Nos. 15, 16, 18 to 22, and 25) corresponding to the data plotted by filled squares fell within the range of $Y>-0.1X+1.4$ and exhibited poor stress corrosion cracking resistance.

As is described above, all 7xxx series aluminum alloy members satisfying the condition as specified by: $Y\leq-0.1X+1.4$ exhibited excellent stress corrosion cracking resistance.

EXAMPLES

Different 7xxx series aluminum alloys given in Table 1 were cast and subjected to a homogenization treatment at 470° C. for 8 hours to give extrusion billets. The extrusion billets were then heated to 470° C., extruded using a porthole into cylindrical pipes having an outer diameter of 90 mm and a wall thickness of 3 mm, and the pipes were subjected to press quenching where the extruded pipes were air-cooled with a fan (blower) immediately after extrusion.

TABLE 1

| | Chemical composition (in mass percent) | | | | | | | | | | Micro-structure | Reversion treatment | | | | Time |
|---|---|---|---|---|---|---|---|---|---|---|---|---|---|---|---|---|
| | | | | | | | | | | | | Temperature rise rate | End-point temperature | Holding time | Cooling rate | until pipe expanding |
| No. | Zn | Mg | Cu | Si | Fe | Ti | Mn | Cr | Zr | Al | | (° C./s) | (° C.) | (s) | (° C./s) | (h) |
| 1 | 5.49 | 0.65 | 0.17 | 0.04 | 0.18 | 0.02 | — | — | — | Remainder | Recrystallized | 11 | 350 | 1 | 17 | 0.25 |
| 2 | 5.49 | 0.65 | 0.17 | 0.04 | 0.18 | 0.02 | — | — | — | Remainder | Recrystallized | 3 | 350 | 1 | 17 | 0.25 |
| 3 | 5.49 | 0.65 | 0.17 | 0.04 | 0.18 | 0.02 | — | — | — | Remainder | Recrystallized | 0.5 | 350 | 1 | 17 | 0.25 |
| 4 | 6.61 | 0.83 | 0.16 | 0.07 | 0.17 | 0.03 | — | — | 0.14 | Remainder | Fiber | 3 | 350 | 1 | 440 | 0.25 |
| 5 | 6.61 | 0.83 | 0.16 | 0.07 | 0.17 | 0.03 | 0.24 | — | 0.08 | Remainder | Fiber | 3 | 350 | 1 | 17 | 0.25 |
| 6 | 6.61 | 0.83 | 0.16 | 0.07 | 0.17 | 0.03 | — | — | 0.14 | Remainder | Fiber | 3 | 350 | 1 | 0.7 | 0.25 |
| 7 | 6.52 | 1.4 | 0.15 | 0.04 | 0.17 | 0.03 | — | 0.04 | 0.14 | Remainder | Fiber | 3 | 500 | 1 | 17 | 0.25 |
| 8 | 6.52 | 1.4 | 0.15 | 0.04 | 0.17 | 0.03 | — | 0.04 | 0.14 | Remainder | Fiber | 3 | 200 | 1 | 17 | 0.25 |
| 9 | 6.52 | 1.4 | 0.15 | 0.04 | 0.17 | 0.03 | — | 0.04 | 0.14 | Remainder | Fiber | 3 | 350 | 1 | 17 | 70 |
| 10 | 5.49 | 0.65 | 0.17 | 0.04 | 0.18 | 0.02 | — | — | — | Remainder | Recrystallized | 3 | 350 | 1 | 17 | 0.25 |
| 11 | 6.61 | 0.83 | 0.16 | 0.07 | 0.17 | 0.03 | 0.21 | — | 0.14 | Remainder | Fiber | 3 | 350 | 1 | 17 | 0.25 |

TABLE 1-continued

| No. | Chemical composition (in mass percent) Zn | Mg | Cu | Si | Fe | Ti | Mn | Cr | Zr | Al | Microstructure | Reversion treatment: Temperature rise rate (° C./s) | End-point temperature (° C.) | Holding time (s) | Cooling rate (° C./s) | Time until pipe expanding (h) |
|---|---|---|---|---|---|---|---|---|---|---|---|---|---|---|---|---|
| 12 | 6.52 | 1.4 | 0.15 | 0.04 | 0.17 | 0.03 | — | 0.15 | 0.14 | Remainder | Fiber | 3 | 350 | 1 | 17 | 0.25 |
| 13 | 4.52 | 0.55 | 1.2 | 0.05 | 0.19 | 0.03 | — | — | — | Remainder | Recrystallized | 3 | 350 | 1 | 440 | 0.25 |
| 14 | 9.01 | 2.01 | 0.15 | 0.04 | 0.17 | 0.02 | 0.25 | — | — | Remainder | Fiber | 3 | 350 | 1 | 17 | 0.25 |
| 15 | 5.49 | 0.65 | 0.17 | 0.04 | 0.18 | 0.02 | — | — | — | Remainder | Recrystallized | 3 | 150* | 1 | 17 | 0.25 |
| 16 | 5.49 | 0.65 | 0.17 | 0.04 | 0.18 | 0.02 | — | — | — | Remainder | Recrystallized | 0.02* | 350 | 1 | 17 | 0.25 |
| 17 | 6.61 | 0.83 | 0.16 | 0.07 | 0.17 | 0.03 | — | — | 0.14 | Remainder | Fiber | 3 | 350 | 1 | 0.08* | 0.25 |
| 18 | 6.52 | 1.4 | 0.15 | 0.04 | 0.17 | 0.03 | — | 0.12 | 0.14 | Remainder | Fiber | 3 | 350 | 1 | 17 | 120* |
| 19 | 5.49 | 0.65 | 0.17 | 0.04 | 0.18 | 0.02 | — | — | — | Remainder | Recrystallized | 3 | 150* | 1 | 17 | 0.25 |
| 20 | 4.52 | 0.55 | 1.2 | 0.05 | 0.19 | 0.03 | — | — | — | Remainder | Recrystallized | 3 | 150* | 1 | 17 | 0.25 |
| 21 | 9.01 | 2.01 | 0.15 | 0.04 | 0.17 | 0.02 | — | — | 0.15 | Remainder | Fiber | 3 | 150* | 1 | 440 | 0.25 |
| 22 | 6.52 | 1.4 | 0.15 | 0.04 | 0.17 | 0.03 | — | 0.04 | 0.14 | Remainder | Fiber | —* | —* | —* | —* | — |
| 23 | 4.52 | 0.55 | 1.2 | 0.05 | 0.19 | 0.03 | — | — | 0.16 | Remainder | Fiber | 3 | 350 | 1 | 17 | 0.25 |
| 24 | 9.01 | 2.01 | 0.51 | 0.04 | 0.17 | 0.02 | — | — | 0.15 | Remainder | Fiber | 3 | 500 | 1 | 440 | 0.25 |
| 25 | 4.52 | 0.55 | 1.2 | 0.05 | 0.19 | 0.03 | — | — | — | Remainder | Recrystallized | —* | —* | —* | —* | —* |
| 26 | 6.52 | 1.4 | 0.15 | 0.04 | 0.17 | 0.03 | — | 0.04 | 0.14 | Remainder | Fiber | —* | —* | —* | —* | —* |
| 27 | 5.49 | 0.65 | 0.17 | 0.04 | 0.18 | 0.02 | — | — | — | Remainder | Recrystallized | 3 | 500 | 1 | 440 | 0.25 |
| 28 | 9.03 | 1.98 | 0.14 | 0.04 | 0.17 | 0.02 | — | — | — | Remainder | Recrystallized | 3 | 500 | 1 | 440 | 0.25 |

*Out of the range specified in the present invention

Test samples having a length of 20 mm were sampled in parallel with the extrusion direction from the hollow extrusions (cylindrical pipes) after press quenching, and the grain microstructure in a cross section of each test sample was observed in a manner as follows.

Observation of Grain Microstructure

The cross section of a non-deposit zone of each test sample in parallel with the extrusion direction was etched with Keller's reagent, and the grain microstructure of the etched cross section was observed.

Of the test samples, some included a recrystallized microstructure allover the cross section; some others included a fiber microstructure all over the cross section; and others included a fiber microstructure in most of the cross section (and included a recrystallized microstructure only in a surface layer). Test samples including a recrystallized microstructure all over the cross section were defined as having a recrystallized microstructure; whereas test samples including a fiber microstructure allover or most of the cross section were defined as having a fiber microstructure; and each is indicated in "Microstructure" in Table 1.

The hollow extrusions (cylindrical pipes) after press quenching were cut to a predetermined length, left stand at room temperature for 20 days for natural aging, further aged at 130° C. for 8 hours to yield test samples, and the test samples were subjected to tensile tests in a manner as follows.

Tensile Test

A tensile test specimen JIS 12B was sampled from each test sample and subjected to a tensile test at mom temperature and at a crosshead speed of 2 mm/min to determine a 0.2% yield stress $\sigma_{0.2}$. The results are indicated in Table 2 as "yield stress $\sigma_{0.2}$ after T5 treatment".

Likewise, hollow extrusions were left stand at room temperature for 20 days for natural aging, cut to a predetermined length to give test samples, and the test samples were subjected to reversion treatments at different rates of temperature rise, end-point temperatures (actual work temperatures), holding durations, and cooling rates given in Table 1 using high frequency induction heating equipment, in which Samples Nos. 22, 25, and 26 were not subjected to reversion treatments. After elapse of durations given in Table 1 after the reversion treatments, the test samples were subjected to pipe expanding in a manner as follows and were examined on whether or not cracking occurred. The test samples (expanded pipes) after the pipe expanding were subjected to temper aging at 130° C. for 8 hours, whose expansion rates were measured in a manner as follows, and the test samples were subjected to tensile residual stress measurements and stress corrosion cracking tests. The results are indicated in Table 2.

Pipe Expanding

Two different pipe expanding procedures, i.e., flanging and simple pipe expanding were performed using an electromagnetic forming testing machine. The "electromagnetic forming" refers to a technique of passing a high current on the order of 10 kA or more in a coil momentarily to form a strong magnetic field, and a work (conductor) is formed by the interaction between the magnetic field and an eddy current generated in the work. This technique by itself is publicly known as described typically in JP-A No. 2010-159005 and JP-A No. 2010-69927.

Figures 1, 2B:
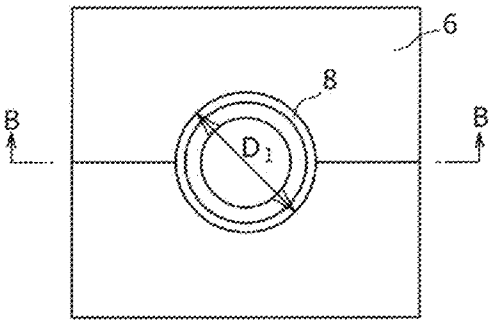
Figures 2, 2B:
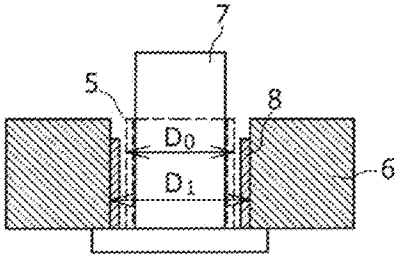
Figures 1, 2A:
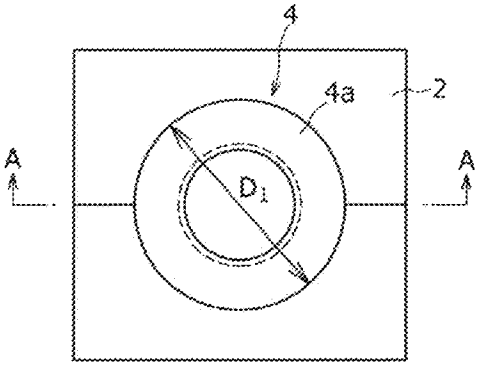
Figures 2, 2A:
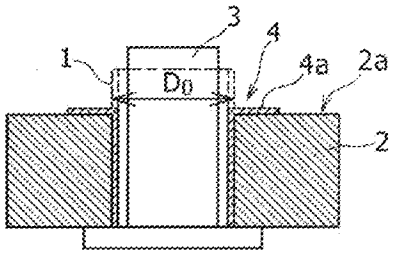

Flanging was applied to Samples Nos. 1 to 9,13 to 18, and 20 to 28. In flanging, a test sample (hollow extrusion) 1 was restrained around by an electromagnetic forming die 2 (including two split dies), only an edge of the test sample 1 was allowed to protrude from an end face (die surface) 2*a* of the die 2, and electrical energy was applied to an electromagnetic forming coil 3 that was inserted into the test sample 1, as illustrated in FIGS. 2A-1 and 2A-2. The edge of each test sample 1 protruded from the die surface 2*a* of the die 2 in a constant length of 65 mm. Identical electrical energy was applied to Samples Nos. 1 to 9, 13 to 18, and 20 to 22; whereas electrical energy higher than or lower than that was applied to Samples Nos. 23 to 28. This process expanded the edge peripheral wall of the test sample 1 outward (in a radial direction) and formed an expanded pipe 4 having a flange 4*a*. The flange of the expanded pipe, when expanded at a low expansion rate, was expanded in the form of a reversed circular truncated cone (in the form of a funnel).

The simple pipe expanding was applied to Samples Nos. 10 to 12 and 19. In the simple pipe expanding with reference to FIGS. 2B-1 and 2B-2, a test sample (hollow extrusion) 5 was housed in an electromagnetic forming die 6 (including two split dies) having an inner diameter larger than that of the test sample 5; an electromagnetic forming coil 7 was inserted into the test sample 5; and electrical energy was applied to the coil 7. The inner diameter of the die 6 was set so as to give an expansion rate of 30%. This process expanded the test sample (pipe) 5 throughout its length to press its peripheral wall to the inner circumferential wall of the die 6 and gave an expanded pipe 8.

The expansion rate was defined by an expression as follows:

$$\text{Expansion rate } \delta(\%)=\{(D_1-D_0)/D_0\}\times 100$$

wherein $D_1$ represents the outer diameter of the flange and $D_0$ represents the outer diameter of the test sample 1 in the flanging; or $D_1$ represents the outer diameter of the test sample 5 after pipe expansion and $D_0$ represents the diameter of the test sample 5 before pipe expansion in the simple pipe expanding.

Tensile Residual Stress Measurement

The residual stress measurement was performed by a cutting process. The measurement was performed in the vicinity of the flange outer periphery of the expanded pipe 4; or performed in the peripheral wall of the expanded pipe 8. The surface of the portion to be measured was polished with sandpaper, washed with acetone, a strain gauge was bonded to the polished portion with an instantaneous adhesive, and the resulting work was left stand at room temperature for 24 hours. A lead wire of the strain gauge was connected to a strain meter, zero-point adjustment was performed, a 10-mm square of the work around the strain gauge was cut with a metal saw to relieve stress, a strain $\epsilon$ after cutting was measured, and a residual stress $\sigma_{rs}$ was calculated according to Expression (4) as follows:

$$\sigma_{rs}=-E\times\epsilon \tag{4}$$

wherein E represents the Young's modulus and is set herein to 68894 N/mm$^2$.

Stress Corrosion Cracking Test

A stress corrosion cracking resistance test was performed by a chromic acid promotion method. Each of the expanded pipes 4 and 8 was immersed in a test solution at 90° C. for a duration of at longest 16 hours, and whether stress corrosion cracking occurred or not was visually observed. The test solution was prepared by adding to distilled water 36 g of chromic anhydride (chromium trioxide), 30 g of potassium dichromate, and 3 g of sodium chloride per 1 liter of the distilled water. In the test, the test sample was taken out from the solution every hour to examine whether cracking occurred or not. A sample suffering from no cracking or suffering from cracking after an elapse of 12 hours or longer was evaluated as having excellent stress corrosion cracking resistance (Good); and a sample suffering from cracking within a duration of shorter than 12 hours was evaluated as having poor stress corrosion cracking resistance (Poor).

TABLE 2

| No. | Expansion rate (%) | Presence/ absence of cracking | Yield stress after T5 treatment $\sigma_{0.2}$ (MPa) | Residual stress $\sigma$ rs (MPa) | $\sigma$ rs/$\sigma_{0.2}$ (=Y) | [Mg] + [Zn] (=X) (%) | Y ≤ −0.1X + 1.4 | −0.1X + 1.4 | Stress corrosion cracking resistance |
|---|---|---|---|---|---|---|---|---|---|
| 1 | 122 | Absent | 268 | 95 | 0.35 | 6.14 | 0.79 | Satisfying | Good |
| 2 | 123 | Absent | 265 | 98 | 0.37 | 6.14 | 0.79 | Satisfying | Good |
| 3 | 120 | Absent | 259 | 102 | 0.39 | 6.14 | 0.79 | Satisfying | Good |
| 4 | 42 | Absent | 330 | 162 | 0.49 | 7.44 | 0.66 | Satisfying | Good |
| 5 | 44 | Absent | 326 | 168 | 0.52 | 7.44 | 0.66 | Satisfying | Good |
| 6 | 43 | Absent | 321 | 172 | 0.54 | 7.44 | 0.66 | Satisfying | Good |
| 7 | 39 | Absent | 426 | 224 | 0.53 | 7.92 | 0.61 | Satisfying | Good |
| 8 | 38 | Absent | 422 | 231 | 0.55 | 7.92 | 0.61 | Satisfying | Good |
| 9 | 38 | Absent | 425 | 243 | 0.57 | 7.92 | 0.61 | Satisfying | Good |
| 10 | 30 | Absent | 269 | 87 | 0.32 | 6.14 | 0.79 | Satisfying | Good |
| 11 | 30 | Absent | 324 | 152 | 0.47 | 7.44 | 0.66 | Satisfying | Good |
| 12 | 30 | Absent | 425 | 213 | 0.50 | 7.92 | 0.61 | Satisfying | Good |
| 13 | 132 | Absent | 225 | 185 | 0.82 | 5.07 | 0.89 | Satisfying | Good |
| 14 | 12 | Absent | 550 | 151 | 0.27 | 11.02 | 0.30 | Satisfying | Good |
| 15 | 100 | Present* | 258 | 243 | 0.94 | 6.14 | 0.79 | Unsatisfying* | Poor* |
| 16 | 125 | Present* | 254 | 251 | 0.99 | 6.14 | 0.79 | Unsatisfying* | Poor* |
| 17 | 58 | Absent | 137* | 80 | 0.58 | 7.44 | 0.66 | Satisfying | Good |
| 18 | 28 | Present* | 438 | 308 | 0.70 | 7.92 | 0.61 | Unsatisfying* | Poor* |
| 19 | 30 | Present* | 256 | 238 | 0.93 | 6.14 | 0.79 | Unsatisfying* | Poor* |
| 20 | 92 | Present* | 220 | 198 | 0.90 | 5.07 | 0.89 | Unsatisfying* | Poor* |
| 21 | 22 | Present* | 549 | 421 | 0.77 | 11.02 | 0.30 | Unsatisfying* | Poor* |
| 22 | 29 | Present* | 420 | 320 | 0.76 | 7.92 | 0.61 | Unsatisfying* | Poor* |
| 23 | 77 | Present* | 298 | 102 | 0.34 | 5.07 | 0.89 | Satisfying | Good |
| 24 | 61 | Present* | 594 | 140 | 0.24 | 11.02 | 0.30 | Satisfying | Good |
| 25 | 31 | Absent | 223 | 201 | 0.90 | 5.07 | 0.89 | Unsatisfying* | Poor * |
| 26 | 4* | Absent | 423 | 250 | 0.59 | 7.92 | 0.61 | Satisfying | Good |
| 27 | 145 | Present* | 270 | 105 | 0.39 | 6.14 | 0.79 | Satisfying | Good |
| 28 | 65 | Present* | 521 | 152 | 0.29 | 11.01 | 0.30 | Satisfying | Good |

*Data out of the range specified in the present invention or evaluated as poor

The ratio Y (=$\sigma_{rs}/\sigma_{0.2}$) of the residual stress ($\sigma_{rs}$) to the 0.2% yield stress ($\sigma_{0.2}$) was calculated from these data. The total content X (=[Zn]+[Mg]) of Zn and Mg; and the right-hand value (−0.1X+1.4) of Expression (1) were calculated from the Zn content [Zn] and the Mg content [Mg]. Based on these calculation results, a sample having X and Y satisfying the condition as specified by Expression (1) was evaluated as "Satisfying"; whereas a sample having X and Y not satisfying the condition was evaluated as "Unsatisfying". The results of the calculations and evaluations are indicated in Table 2.

Figure 3A:
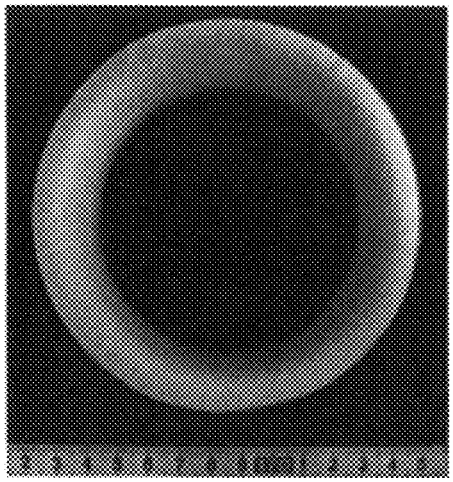
FIGS. 3A and 3B are plan views (photographs) of hollow extrusions after pipe expanding in working examples.

Tables 1 and 2 demonstrate as follows. The hollow extrusions of Samples Nos. 1 to 14 each having an alloy chemical composition specified in the present invention and undergoing reversion treatment and pipe expanding under conditions specified in the present invention could be expanded each at a practical-level expansion rate without cracking due to pipe expanding. These hollow extrusions each had a yield stress after temper aging (T5 treatment) of 200 MPa or more, had Y ($=\sigma_{rs}/\sigma_{0.2}$) and X (=[Zn]+[Mg]) satisfying the condition as specified in the present invention by Expression (1), and exhibited excellent stress corrosion cracking resistance. FIG. 3A depicts a plan view (photograph) of Sample No. 5 after pipe expanding, in which the flange did not suffer from cracking.

In contrast, the hollow extrusion of Sample No. 15 underwent a reversion treatment performed at an excessively low end-point temperature (holding temperature), failed to enjoy sufficient effects of the reversion treatment, and the resulting expanded pipe suffered from cracking due to pipe expanding. In addition, the expanded pipe had Y ($=\sigma_{rs}/\sigma_{0.2}$) and X (=[Zn]+[Mg]) not satisfying the condition as specified in the present invention by Expression (1) and thereby exhibited poor stress corrosion cracking resistance.

The hollow extrusion of Sample No. 16 underwent a reversion treatment performed at an excessively low rate of temperature rise, failed to enjoy sufficient effects of the reversion treatment, and the resulting expanded pipe suffered from cracking due to pipe expanding. In addition, the expanded pipe had Y ($=\sigma_{rs}/\sigma_{0.2}$) and X (=[Zn]+[Mg]) not satisfying the condition as specified in the present invention by Expression (1) and thereby exhibited poor stress corrosion cracking resistance.

The hollow extrusion of Sample No. 17 underwent cooling after the reversion treatment at an excessively low cooling rate, thereby became an annealed aluminum material, and caused the resulting expanded pipe after temper aging to fail to have a required strength (200 MPa or more). The expanded pipe, however, had Y ($=\sigma_{rs}/\sigma_{0.2}$) and X (=[Zn]+[Mg]) satisfying the condition as specified in the present invention by Expression (1) and had good stress corrosion cracking resistance.

The hollow extrusion of Sample No. 18 underwent a reversion treatment performed under appropriate conditions, but was held between the reversion treatment and pipe expanding for an excessively long duration, thereby lost effects of the reversion treatment, and the resulting expanded pipe suffered from cracking due to pipe expanding. In addition, the expanded pipe had Y ($=\sigma_{rs}/\sigma_{0.2}$) and X (=[Zn]+[Mg]) not satisfying the condition as specified in the present invention by Expression (1) and exhibited poor stress corrosion cracking resistance.

The hollow extrusions of Samples Nos. 19 to 21 each underwent a reversion treatment performed at an excessively low end-point temperature (holding temperature), failed to enjoy sufficient effects of the reversion treatment, and the resulting expanded pipes suffered from cracking due to pipe expanding. In addition, the expanded pipes had Y ($=\sigma_{rs}/\sigma_{0.2}$) and X (=[Zn]+[Mg]) not satisfying the condition as specified in the present invention by Expression (1) and exhibited poor stress corrosion cracking resistance.

The hollow extrusion of Sample No. 22 did not undergo a reversion treatment, and the resulting expanded pipe suffered from cracking due to pipe expanding. In addition, the expanded pipe had Y ($=\sigma_{rs}/\sigma_{0.2}$) and X (=[Zn]+[Mg]) not satisfying the condition as specified in the present invention by Expression (1) and exhibited poor stress corrosion cracking resistance.

Figure 3B:
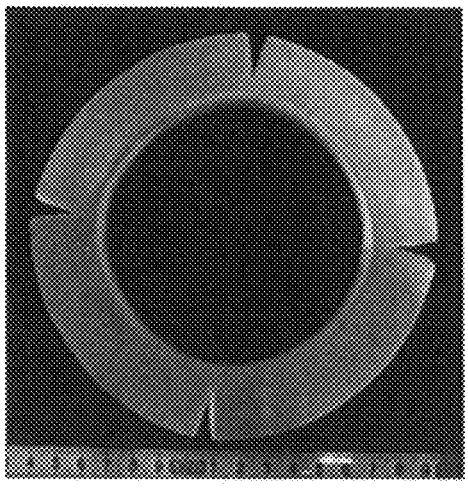

The hollow extrusions of Samples Nos. 23 and 24 each underwent a reversion treatment under appropriate conditions and holding between the reversion treatment and pipe expanding for an appropriate duration. However, these hollow extrusions had a fiber microstructure, thereby required a large amount of electrical energy to be applied for pipe expanding, underwent pipe expanding at an excessively high expansion rate, and suffered from cracking upon pipe expanding. The hollow extrusions, however, had Y ($=\sigma_{rs}/\sigma_{0.2}$) and X (=[Zn]+[Mg]) satisfying the condition as specified in the present invention by Expression (1) and had good stress corrosion cracking resistance, because they each underwent a reversion treatment under appropriate conditions and holding between the reversion treatment and pipe expanding for an appropriate duration. FIG. 3B depicts a plan view (photograph) of the expanded pipe of Sample No. 23 after pipe expanding, in which cracking occurred in a deposit zone of the flange.

The hollow extrusion of Sample No. 25 did not undergo a reversion treatment, but had a recrystallized microstructure with a relatively low alloy composition, and underwent pipe expanding by the application of low electrical energy at a low expansion rate, and did not suffer from cracking due to pipe expanding. The resulting expanded pipes, however, had Y ($=\sigma_{rs}/\sigma_{0.2}$) and X (=[Zn]+[Mg]) not satisfying the condition as specified in the present invention by Expression (1) and exhibited poor stress corrosion cracking resistance.

The hollow extrusion of Sample No. 26 did not undergo a reversion treatment, but underwent pipe expanding with a small amount of applied electrical energy and at a low expansion rate of 4%, and the resulting expanded pipe did not suffer from cracking even after pipe expanding. The expanded pipe had Y ($=\sigma_{rs}/\sigma_{0.2}$) and X (=[Zn]+[Mg]) satisfying the condition specified by Expression (1) in present invention and had good stress corrosion cracking resistance. It should be noted, however, that the expansion rate herein is lower than the practical level.

The hollow extrusions of Samples Nos. 27 and 28 underwent pipe expanding with an excessively large amount of applied electrical energy and at an excessively high expansion rate and suffered from cracking due to pipe expanding. These hollow extrusions, however, underwent a reversion treatment under appropriate conditions, and the resulting expanded pipes had Y ($=\sigma_{rs}/\sigma_{0.2}$) and X (=[Zn]+[Mg]) satisfying the condition as specified in the present invention by Expression (1) and had good stress corrosion cracking resistance.

What is claimed is:

1. A method for manufacturing a 7xxx series aluminum alloy member, the method comprising:

subjecting a 7xxx series aluminum alloy hollow extrusion to a reversion treatment;

subjecting the hollow extrusion to pipe expanding at an expansion rate of 5% or more within 72 hours after the reversion treatment to give a member; and temper aging the member after the pipe expanding;

wherein:

the 7xxx series aluminum alloy hollow extrusion comprises:

Zn in a content of from 3.0 to 9.5 percent by mass;

Mg in a content of from 0.4 to 2.5 percent by mass;

Cu in a content of from 0.05 to 2.0 percent by mass;

Ti in a content of from 0.005 to 0.2 percent by mass; and

Al;

the hollow extrusion is manufactured through press quenching; and the reversion treatment comprises:

heating the hollow extrusion at a rate of temperature rise of 0.4° C./second or more;

holding the hollow extrusion in a temperature range of from 200° C. to 550° C. for a duration of longer than 0 second; and subsequently cooling the hollow extrusion at a cooling rate of 0.5° C./second or more.

2. The method according to claim 1, wherein the 7xxx series aluminum alloy hollow extrusion further comprises at least one element selected from the group consisting of:

Mn in a content of from 0.01 to 0.3 percent by mass;

Cr in a content of from 0.01 to 0.3 percent by mass; and

Zr in a content of from 0.01 to 0.3 percent by mass.

3. A 7xxx series aluminum alloy member, formed by a process comprising:

subjecting a 7xxx series aluminum alloy hollow extrusion to pipe expanding at an expansion rate of 5% or more to give a member; and temper aging the member after the pipe expanding, wherein:

the 7xxx series aluminum alloy hollow extrusion comprises:

Zn in a content of from 3.0 to 9.5 percent by mass;

Mg in a content of from 0.4 to 2.5 percent by mass;

Cu in a content of from 0.05 to 2.0 percent by mass;

Ti in a content of from 0.005 to 0.2 percent by mass; and

Al, and the member after the temper aging satisfies conditions as specified by Expressions (1) to (3) as follows:

$$Y \leq -0.1X + 1.4 \quad (1)$$

$$Y = \sigma_{rs}/\sigma_{0.2} \quad (2)$$

$$X = [Mg] + [Zn] \quad (3)$$

where $\sigma_{rs}$ represents a tensile residual stress after the temper aging; $\sigma_{0.2}$ represents a 0.2% yield stress of the member after the temper aging; and [Mg] and [Zn] represent contents in mass percent of Mg and Zn, respectively.

4. The 7xxx series aluminum alloy member according to claim 3, wherein the 7xxx series aluminum alloy hollow extrusion further comprises at least one element selected from the group consisting of:

Mn in a content of from 0.01 to 0.3 percent by mass;

Cr in a content of from 0.01 to 0.3 percent by mass; and

Zr in a content of from 0.01 to 0.3 percent by mass.

5. The 7xxx series aluminum alloy member according to claim 3, wherein Fe and Si are present in the 7xxx series aluminum alloy hollow extrusion as impurity elements in a content of 0.35 percent by mass or less and 0.3 percent by mass or less, respectively.

6. The 7xxx series aluminum alloy member according to claim 3, wherein the member after the temper aging has a yield stress of 200 MPa or more.

7. The 7xxx series aluminum alloy member according to claim 3, wherein the process further comprising:

within 72 hours before the pipe expanding, subjecting the 7xxx series aluminum alloy hollow extrusion to a reversion treatment, which comprises heating the hollow extrusion at a rate of temperature rise of 0.4° C./second or more;

holding the hollow extrusion in a temperature range of from 200° C. to 550° C. for a duration of longer than 0 second; and subsequently cooling the hollow extrusion at a cooling rate of 0.5° C./second or more.

* * * * *